US012352191B2

(12) United States Patent
Shouji

(10) Patent No.: US 12,352,191 B2
(45) Date of Patent: Jul. 8, 2025

(54) FILTER ABNORMALITY DETERMINATION SYSTEM

(71) Applicant: TOYOTA JIDOSHA KABUSHIKI KAISHA, Toyota (JP)

(72) Inventor: Junpei Shouji, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/364,677

(22) Filed: Aug. 3, 2023

(65) Prior Publication Data

US 2024/0133332 A1 Apr. 25, 2024
US 2024/0229699 A9 Jul. 11, 2024

(30) Foreign Application Priority Data

Oct. 24, 2022 (JP) ..... 2022-170028

(51) Int. Cl.
*F01N 11/00* (2006.01)
*F01N 3/10* (2006.01)

(52) U.S. Cl.
CPC ..... *F01N 11/007* (2013.01); *F01N 3/101* (2013.01); *F01N 2550/02* (2013.01)

(58) Field of Classification Search
CPC .... F01N 11/007; F01N 3/101; F01N 2550/02; F01N 2560/025
See application file for complete search history.

(56) References Cited

U.S. PATENT DOCUMENTS 6,082,103 A * 7/2000 Sugiura ..... F01N 13/08 60/272
6,722,126 B2 * 4/2004 Kawamizu ..... F01N 13/008 60/299
10,480,368 B2 * 11/2019 Santillo ..... F01N 13/008
11,230,956 B2 * 1/2022 Yashiro ..... F01N 13/18
2008/0053066 A1 * 3/2008 Nakagome ..... F01N 1/166 60/276
2011/0072787 A1 * 3/2011 Hubbard ..... F02D 41/1454 123/703
2012/0198824 A1 * 8/2012 Nishioka ..... F01N 3/031 60/297

(Continued)

FOREIGN PATENT DOCUMENTS

JP 2008-075458 A 4/2008
JP 2018-162721 A 10/2018
JP 2020-012424 A 1/2020

*Primary Examiner* — Matthew T Largi
(74) *Attorney, Agent, or Firm* — SoraIP, Inc.

(57) ABSTRACT

A filter abnormality determination system includes: an internal combustion engine having a plurality of cylinders; an exhaust passage connected to the internal combustion engine; a filter provided in the exhaust passage and opposed to the filter and outputting a detection value corresponding to an oxygen concentration in the exhaust gas; and a determination device, wherein the determination device includes a control unit that executes an imbalance control for controlling an air-fuel ratio of one of the plurality of cylinders to a value different from an air-fuel ratio of another of the plurality of cylinders; and a determination unit for determining whether the filter is abnormal based on a detection value of the sensor corresponding to an air-fuel ratio of an exhaust gas of the one cylinder during execution of the imbalance control.

2 Claims, 5 Drawing Sheets

(56) References Cited

U.S. PATENT DOCUMENTS

| | | | | |
|---|---|---|---|---|
| 2012/0216507 | A1* | 8/2012 | Nieuwstadt | F01N 13/009 60/274 |
| 2014/0060690 | A1* | 3/2014 | Jang | F01N 13/1872 138/155 |
| 2015/0128587 | A1* | 5/2015 | Dane | F02D 41/0065 123/542 |
| 2015/0275738 | A1* | 10/2015 | Van Nieuwstadt | B01D 46/30 73/114.76 |
| 2017/0284268 | A1* | 10/2017 | Nakagawa | F01N 11/002 |
| 2019/0292956 | A1* | 9/2019 | Shibuya | F02D 41/1439 |

* cited by examiner

FILTER ABNORMALITY DETERMINATION SYSTEM

CROSS-REFERENCE TO RELATED APPLICATION

This application claims priority to Japanese Patent Application No. 2022-170028 filed on Oct. 24, 2022, incorporated herein by reference in its entirety.

BACKGROUND

1. Technical Field

The present disclosure relates to a filter abnormality determination system.

2. Description of Related Art

A technique is known in which an abnormality of a filter is determined based on a delay from a time when an air-fuel ratio of an internal combustion engine is changed until a time when an air-fuel ratio sensor detects the change (see, for example, Japanese Unexamined Patent Application Publication No. 2008-075458 (JP 2008-075458 A)).

SUMMARY

Due to the fluctuation of the air-fuel ratio, a combustion state of the internal combustion engine may change, which may affect fuel efficiency, output performance, exhaust emission, and the like.

On the basis of the above, an object of the present disclosure is to provide a filter abnormality determination system capable of determining an abnormality of a filter while suppressing an influence on a combustion state of an internal combustion engine.

An aspect of the present disclosure provides a filter abnormality determination system. The filter abnormality determination system includes: an internal combustion engine including a plurality of cylinders; an exhaust passage connected to the internal combustion engine; a filter provided in the exhaust passage; a sensor that is provided in the exhaust passage so as to face the filter and that outputs a detection value corresponding to an oxygen concentration in an exhaust gas; and a determination device.

The determination device includes a control unit that executes imbalance control for controlling an air-fuel ratio of one of the cylinders to a value different from an air-fuel ratio of the other remaining cylinders, and a determination unit that determines whether the filter is abnormal based on the detection value of the sensor corresponding to the air-fuel ratio of an exhaust gas of the one cylinder while the imbalance control is executed.

The imbalance control may control the air-fuel ratio of the one cylinder to a rich air-fuel ratio that is smaller than a stoichiometric air-fuel ratio or the air-fuel ratio of the one cylinder to a lean air-fuel ratio that is larger than the stoichiometric air-fuel ratio, and the determination unit may determine whether the filter is abnormal by comparing the detection value of the sensor corresponding to the air-fuel ratio of the exhaust gas of the one cylinder with a determination value.

The exhaust passage may include a curved portion that is located upstream of the filter, and that extends and is curved to face the filter, and the sensor may be provided in the curved portion.

The exhaust passage may include a linear portion that is located upstream of the filter, and that extends linearly to face the filter, and the sensor may be provided in the linear portion.

The sensor may be provided downstream of the filter.

According to the present disclosure, the filter abnormality determination system capable of determining an abnormality of the filter while suppressing an influence on the combustion state of the internal combustion engine can be provided.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Outline Configuration of Filter Abnormality Determination System

Figure 1:
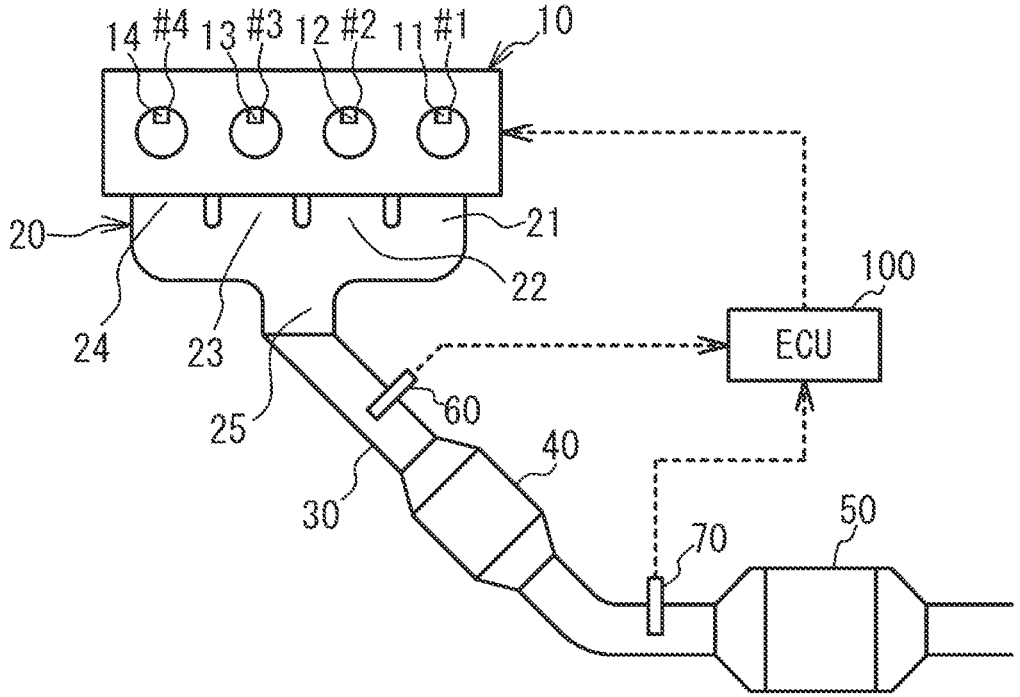
FIG. 1 is a schematic configuration diagram of filter abnormality determination system according to the present embodiment.

FIG. 1 is a schematic configuration diagram of filter abnormality determination system 1 according to the present embodiment. The filter abnormality determination system 1 includes an engine 10, an exhaust manifold 20, an exhaust passage 30, a three-way catalyst 40, a Gasoline Particulate Filter (GPF) 50, air-fuel ratio sensors 60 and 70, and an Electronic Control Unit (ECU) 100. The engine 10 is an example of an internal combustion engine, and is a spark ignition type gasoline engine, but may be a compression ignition type diesel engine. The engine 10 is a four-cycle engine that constitutes one combustion cycle in an intake stroke, a compression stroke, an expansion stroke, and an exhaust stroke. The engine 10 has four cylinder #1 to #4, but is not limited thereto as long as it has a plurality of cylinders. In the cylinder #1 to the #4, the exhaust stroke is executed in the order of the cylinder #1, the #3, the #4, and the #2, that is, the exhaust is performed at different timings. In each of the cylinder #1 to the #4, the in-cylinder injection valves 11 to 14 for injecting fuel into the cylinder are provided, but the present disclosure is not limited thereto. For example, in addition to the in-cylinder injection valves 11 to 14 or in place of the in-cylinder injection valves 11 to 14, a port injection valve that injects fuel from the cylinder #1 to the respective intake ports of the #4 may be provided. An intake pipe is connected to the engine 10 via an intake manifold.

The exhaust manifold 20 is connected to the engine 10, and the exhaust gas discharged from each of the #4 from the cylinder #1 passes therethrough. Specifically, the exhaust manifold 20 includes branch pipes 21 to 24 connected from the cylinder #1 to each of the #4, and a collecting pipe portion 25 connected by collecting them downstream. The exhaust passage 30 is connected to a downstream end of the collecting pipe portion 25 of the exhaust manifold 20. The exhaust gas discharged from the cylinder #1 to the #4 at different timings flows through the exhaust passage 30 through the exhaust manifold 20. In the exhaust passage 30, an air-fuel ratio sensor 60, a three-way catalyst 40, an air-fuel ratio sensor 70, and a GPF 50 are arranged in this order from the upstream side to the downstream side.

The air-fuel ratio sensor 60 detects the air-fuel ratio of the exhaust gas discharged from the engine 10 and flowing into the three-way catalyst 40. The air-fuel ratio sensor 70 detects the air-fuel ratio of the exhaust gas discharged from the three-way catalyst and flowing into GPF 50. The air-fuel ratio detected by the air-fuel ratio sensors 60 and 70 is a value correlated with the oxygen concentration in the exhaust gas. Therefore, the air-fuel ratio sensor 70 is an example of a sensor that outputs a detection value corresponding to the oxygen concentration in the exhaust gas. The air-fuel ratio sensor 70 is provided at a position facing GPF 50.

The three-way catalyst 40 includes, for example, a catalyst metal such as platinum (Pt), palladium (Pd), or rhodium (Rh), has an oxygen-absorbing ability, and purifies NOx, HC and CO. GPF 50 is a porous ceramic structure, and collects exhaust fine particles (hereinafter, referred to as Particulate Matter (PM) in exhaust gases. GPF 50 is an exemplary filter. For example, when the engine 10 is a diesel engine, a Diesel Particulate Filter (DPF) is provided instead of GPF 50.

ECU 100 is an electronic control unit including Central Processing Unit (CPU), Read Only Memory (ROM), Random Access Memory (RAM), and back-up RAM. ECU 100 is electrically connected to the air-fuel ratio sensors 60 and 70, and the measured values of the various sensors are inputted. ECU 100 controls the fuel-injection amounts and the like from the in-cylinder injection valves 11 to 14 based on the detection results of the air-fuel ratio sensors 60 and 70.

ECU 100 executes a determination control for determining an anomaly in GPF 50 based on a detection value of the air-fuel ratio sensor 70 during execution of an imbalance control, which will be described later. ECU 100 is an exemplary determination device, and a control unit and a determination unit described later in detail are functionally implemented.

The imbalance control is a control for changing the air-fuel ratio of any one of the cylinder #1 to the #4 to a value that differs from the air-fuel ratio of the remaining other cylinders. For example, in the present embodiment, imbalance control is realized by controlling the air-fuel ratio of the #4 from the cylinder #2 to the stoichiometric air-fuel ratio while controlling the air-fuel ratio of the cylinder #1 to a rich air-fuel ratio smaller than the stoichiometric air-fuel ratio. Specifically, the imbalance control is realized by increasing the fuel injection amount of the in-cylinder injection valve 11 of the cylinder #1 by a predetermined amount from when all the air-fuel ratios of the cylinder #1 to the #4 are controlled to the stoichiometric air-fuel ratio. During the execution of the imbalance control, the respective air-fuel ratios of the exhaust gas from the cylinder #2 to the #4 indicate approximately the stoichiometric air-fuel ratio, while the air-fuel ratio of the exhaust gas from the cylinder #1 indicates the rich air-fuel ratio. That is, the air-fuel ratio of the exhaust gas from the cylinder #1 is smaller than the respective air-fuel ratios of the exhaust gas from the cylinder #2 to the #4.

Figure 2A:
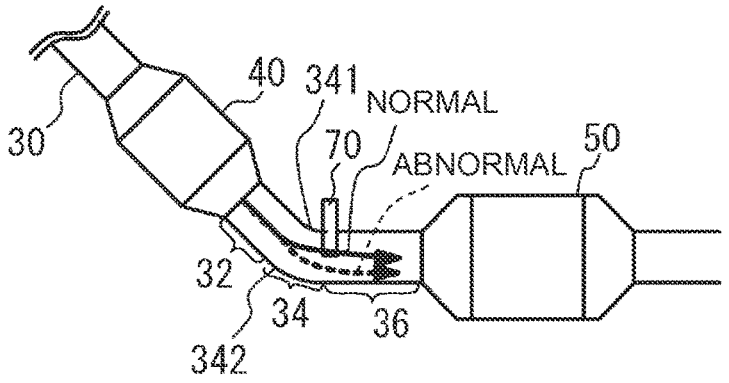
FIG. 2A is an enlarged view of the air-fuel ratio sensor surroundings.

The vicinity of the air-fuel ratio sensor 70 will be described in detail. FIG. 2A is an enlarged view of the vicinity of the air-fuel ratio sensor 70. A linear portion 32, a curved portion 34, and a linear portion 36 are formed in this order from the upstream side to the downstream side between the three-way catalyst 40 and GPF 50 of the exhaust passage 30. The linear portions 32 and 36 extend in a straight line. The curved portion 34 is curved and extends at a predetermined curvature. The air-fuel ratio sensor 70 is provided at the downstream end of the curved portion 34. The curved portion 34 curved with a predetermined curvature includes an inner wall portion 341 and an outer wall portion 342 that face each other in the radial direction of curvature. The outer wall portion 342 has a larger radius of curvature than the inner wall portion 341. The air-fuel ratio sensor 70 is provided on the side of the inner wall portion 341, and the leading end of the air-fuel ratio sensor 70 is provided so as to be located near the center of the passage cross section of the exhaust passage 30.

Filter Error

Figure 2B:
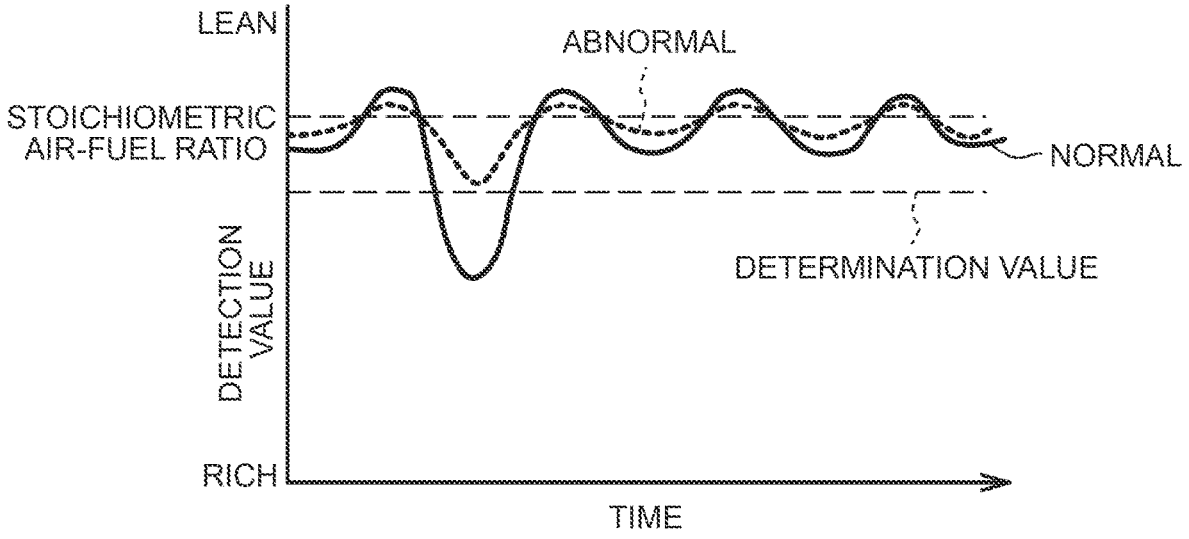
FIG. 2B is an explanatory diagram of a difference in the detected air-fuel ratio of the air-fuel ratio sensor between when GPF is normal and when the air-fuel ratio sensor is abnormal during execution of the imbalance control.

Next, an anomaly in GPF 50 will be described. In FIG. 2A, an arrow indicates the difference in the flow of the exhaust gas between the normal state and the abnormal state of GPF 50 during the execution of the imbalance control. FIG. 2B is an explanatory diagram of a difference in the detected air-fuel ratio of the air-fuel ratio sensor 70 when GPF 50 during the execution of the imbalance control is normal and abnormal. In FIGS. 2A and 2B, the case in the normal state is indicated by a solid line, and the case in the abnormal state is indicated by a dotted line. Here, the abnormal state of GPF 50 is, for example, a case where a part of GPF 50 is defective or dissolved. In this case, the pressure loss of the exhaust gas becomes smaller than that in the normal state.

As shown in FIG. 2A, in the normal state, the exhausted gas flows in the vicinity of the center of the passage cross section of the curved portion 34. On the other hand, in the abnormal case, since the pressure loss of the exhaust gas becomes smaller than in the normal case, the exhaust gas flows to the side of the outer wall portion 342. As a result, the flow rate of the exhaust gas that collides with the air-fuel ratio sensor 70 is lower than that in the normal state in the abnormal state. Therefore, as shown in FIG. 2B, the variation range of the detected air-fuel ratio of the air-fuel ratio sensor 70 is reduced in the abnormal state than in the normal state. Therefore, during the execution of the imbalance control, the detected air-fuel ratio of the exhaust gas of the cylinder #1 by the air-fuel ratio sensor 70 is higher than that in the normal state in the abnormal state. That is, in the abnormal state, the degree of richness is lower than in the normal state. In this way, it is possible to determine whether GPF 50 is normal or abnormal based on the detected air-fuel ratio of the exhaust gas of the cylinder #1 by the air-fuel ratio sensor 70.

Anomaly Determination Control

Figure 3:
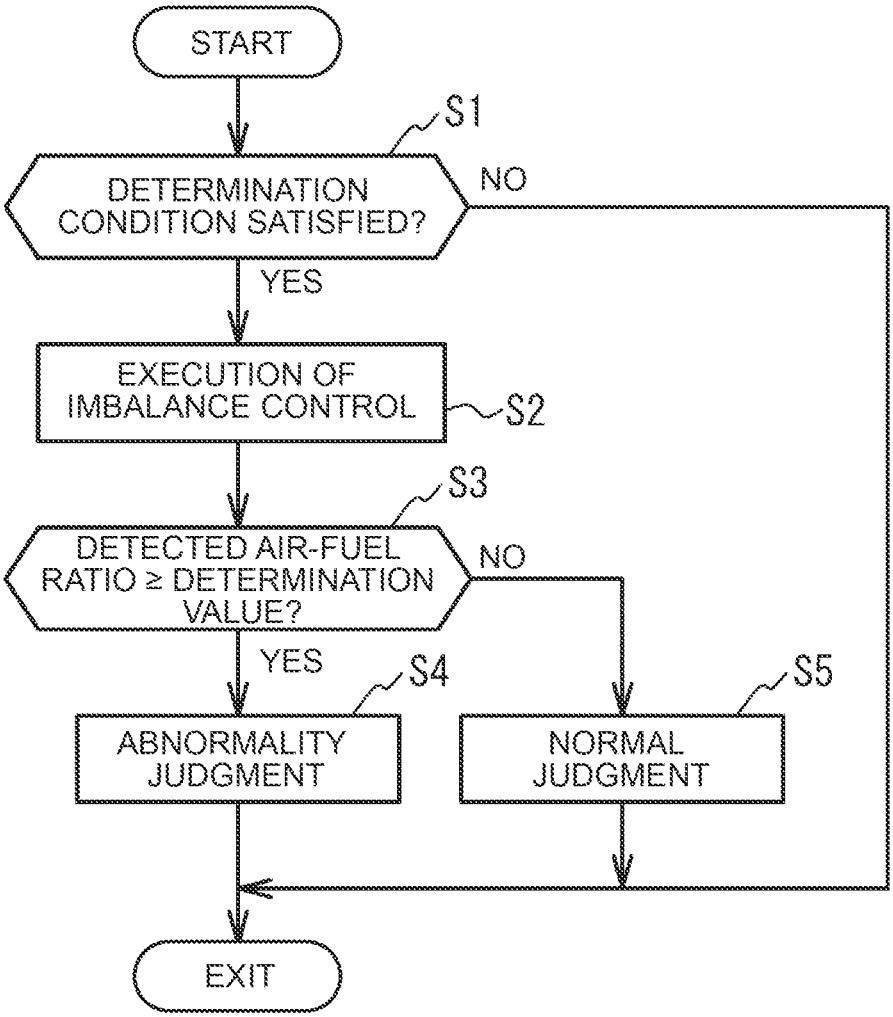
FIG. 3 is a flow chart illustrating an exemplary anomaly determination control executed by ECU.

FIG. 3 is a flow chart illustrating an exemplary anomaly determination control executed by ECU 100. This control is repeatedly executed at predetermined intervals in a state where the ignition is on. ECU 100 determines whether or not a predetermined determination condition is satisfied (S1). The determination condition is a condition indicating that the operating state of the engine 10 is not a transient state. For example, the determination condition is a condition that the rate of change in the rotational speed of the engine 10 and the rate of change in the accelerator operation amount fall within a predetermined range, and that the warm-up control, the regeneration control of GPF 50, and the fuel-cut control are being stopped. If S1 is No, this control ends. If S1 is Yes, ECU 100 performs imbalance control (S2).

Next, ECU 100 determines whether or not the detected air-fuel ratio of the exhaust gas of the cylinder #1 by the air-fuel ratio sensor 70 is equal to or greater than the determination value (S3). The determination value indicates the smallest value of the air-fuel ratio of the exhaust gas of the cylinder #1 by the air-fuel ratio sensor 70 when GPF 50 is abnormal during the execution of the imbalance control. The determination value is set in advance based on an experiment result or a simulation result. Whether the detected air-fuel ratio of the air-fuel ratio sensor 70 is the air-fuel ratio of the exhaust gas of the cylinder #1 or the other air-fuel ratio of the exhaust gas of the cylinder can be determined by the engine speed and the respective combustion timings in the #4 from the cylinder #1. The determination value may be a fixed value, or may be a variable value that varies in accordance with an intake air amount or an engine speed.

If S3 is Yes, ECU 100 determines that GPF 50 is abnormal (S4). When the abnormality determination of GPF 50 is performed, for example, ECU 100 may notify the drivers that an abnormality has occurred in GPF 50 by turning on Malfunction Indicator Light (MIL). If S3 is No, ECU 100 determines that GPF 50 is normal (S5).

As described above, the imbalance control executed to determine the anomaly of GPF 50 is performed by changing only the air-fuel ratio of the cylinder #1. Therefore, it is possible to determine an abnormal GPF 50 while suppressing the effect on the burning condition of the engine 10, as compared with the case where the imbalance control is executed by changing the air-fuel ratios of all the cylinders. As a result, the execution frequency of the abnormality determination control can be ensured.

Further, as illustrated in FIG. 2A, by providing the air-fuel ratio sensor 70 in the curved portion 34, the flow rate of the exhaust gas that collides with the air-fuel ratio sensor 70 at the normal time and the abnormal time of GPF 50 greatly changes. Accordingly, it is possible to accurately determine the anomaly of GPF 50.

In the above embodiment, the air-fuel ratio of the cylinder #1 is controlled to a rich air-fuel ratio smaller than the stoichiometric air-fuel ratio as the imbalance control, but the present disclosure is not limited thereto and may be controlled to a lean air-fuel ratio larger than the stoichiometric air-fuel ratio. Specifically, this imbalance control can be realized by reducing the fuel injection amount of the in-cylinder injection valve 11 of the cylinder #1 by a predetermined amount from the condition in which all the air-fuel ratios of the cylinder #1 to the #4 are controlled to the stoichiometric air-fuel ratio. Here, the detected air-fuel ratio of the cylinder #1 by the air-fuel ratio sensor 70 becomes smaller than that in the normal state in the abnormal state. That is, in the abnormal state, the lean degree is lower than in the normal state. Therefore, when the detected air-fuel ratio of the cylinder #1 by the air-fuel ratio sensor 70 is equal to or lower than a predetermined determination value, it is determined that GPF 50 is abnormal. From the viewpoint of suppressing deterioration in fuel efficiency, it is preferable to realize the imbalance control by controlling the air-fuel ratio of the cylinder #1 to the lean air-fuel ratio. In addition, from the viewpoint of suppressing misfire in the engine 10, it is preferable to realize imbalance control by controlling the air-fuel ratio of the cylinder #1 to a rich air-fuel ratio.

The imbalance control may be realized by controlling the respective air-fuel ratios of the #4 from the cylinder #2 to the lean air-fuel ratio so that the amount of decrease in the air-fuel ratio from the stoichiometric air-fuel ratio when the air-fuel ratio in the cylinder #1 is controlled to the rich air-fuel ratio is offset. In addition, the respective air-fuel ratios of the cylinder #2 to the #4 may be controlled to be rich air-fuel ratios so that the amount of increase in the air-fuel ratio from the stoichiometric air-fuel ratio when the air-fuel ratio in the cylinder #1 is controlled to be the lean air-fuel ratio is offset. In either case, the fluctuation of the air-fuel ratio in the entire engine 10 can be suppressed, and thus the fluctuation of the output of the engine 10 due to the imbalance control can be suppressed.

The imbalance control may be realized, for example, by changing the air-fuel ratio of two or more cylinders. However, if the air-fuel ratio of all the cylinders is changed, the influence on the combustion state is large, and therefore it is preferable not to change the air-fuel ratio for at least one of the remaining cylinders. Alternatively, when the air-fuel ratio of the plurality of cylinders is changed to the rich air-fuel ratio, it is preferable that the air-fuel ratio of the remaining cylinders is not changed or is changed to the lean side. Similarly, when the air-fuel ratio of the plurality of cylinders is changed to the lean air-fuel ratio, it is preferable that the air-fuel ratio of the remaining cylinders is not changed or is changed to the rich side.

First Modification

Figure 4A:
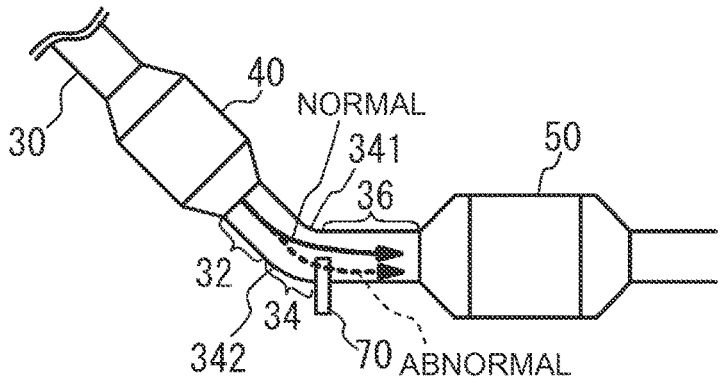
FIG. 4A is an explanatory view of a first modification.
Figure 4B:
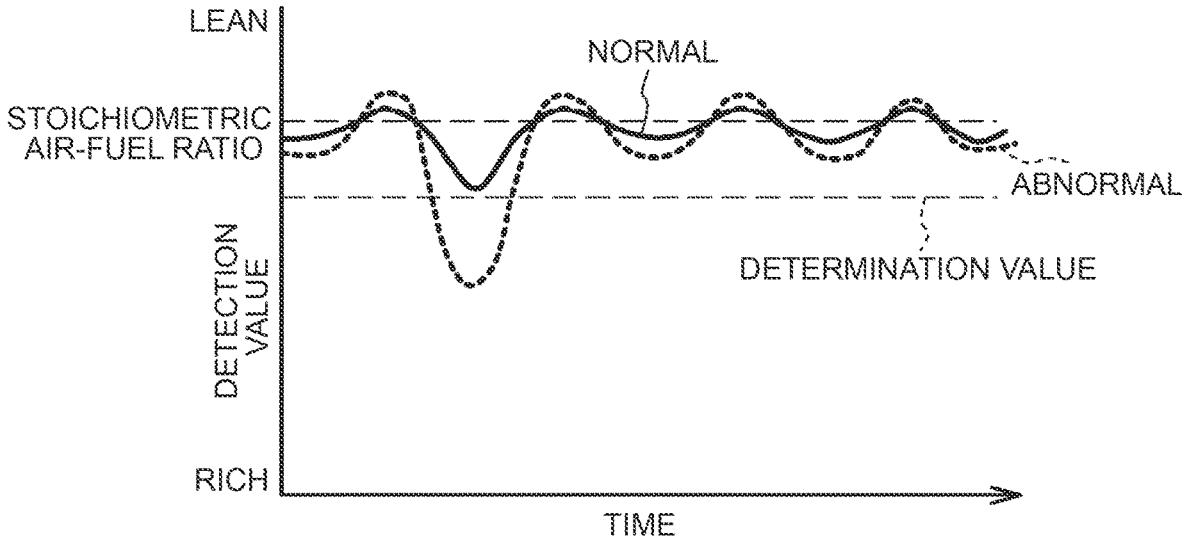
FIG. 4B is another explanatory view of the first modification.

Next, a plurality of modification examples will be described. Regarding the modified example, the same components as those of the above-described embodiment are denoted by the same reference numerals, and redundant descriptions thereof will be omitted. FIGS. 4A and 4B are explanatory views of a first modification. FIGS. 4A and 4B correspond to FIGS. 2A and 2B, respectively. In the first modification, the air-fuel ratio sensor 70 is provided on the side of the outer wall portion 342. Unlike the above-described embodiment, the flow rate of the exhaust gas that collides with the air-fuel ratio sensor 70 increases in the abnormal state than in the normal state. Therefore, even if the same imbalance control as in the above-described embodiment is executed, the detected air-fuel ratio of the exhaust gas of the cylinder #1 is lower than that in the normal state in the abnormal state, unlike the above-described embodiment. That is, in the abnormal state, the degree of richness increases compared to the normal state. Therefore, in the first modification, ECU 100 determines that GPF 50 is abnormal when the detected air-fuel ratio of the exhaust gas of the cylinder #1 by the air-fuel ratio sensor 70 is equal to or lower than a predetermined determination value. The determination value indicates the largest value of the air-fuel ratio of the exhaust gas of the cylinder #1 by the air-fuel ratio sensor 70 when GPF 50 is abnormal during the execution of the imbalance control.

Since the imbalance control is performed by changing only the air-fuel ratio of the cylinder #1 in the first modification, it is possible to determine an abnormal GPF 50 while suppressing an effect on the burning condition of the engine 10. Also in the first modification, the air-fuel ratio sensor 70 is provided in the curved portion 34. Therefore, the flow rate of the exhaust gas that collides with the air-fuel ratio sensor 70 at the normal time and the abnormal time of GPF 50 greatly changes, and the abnormality of GPF 50 can be accurately determined.

Also in the first modification, the air-fuel ratio of the cylinder #1 may be controlled to be leaner than the stoichiometric air-fuel ratio. Here, the detected air-fuel ratio of the cylinder #1 by the air-fuel ratio sensor 70 becomes larger than that in the normal state in the abnormal state. That is, in the abnormal state, the lean degree increases more than in the normal state. Therefore, when the detected air-fuel ratio of the cylinder #1 by the air-fuel ratio sensor 70 is equal to or larger than a predetermined determination value, it is determined that GPF 50 is abnormal.

In the first modification and the above-described embodiment, the air-fuel ratio sensor 70 is provided in the curved portion 34, but it may be provided in the linear portion 36 on the downstream side of the curved portion 34. Also in this case, the exhaust gas flows in the vicinity of the center of the passage cross section of the linear portion 36 in the normal state of GPF 50, whereas in the abnormal state, the exhaust gas flows in a biased manner toward one side of the side wall of the linear portion 36. As a consequence, the flow rate of the exhaust gas that collides with the air-fuel ratio sensor 70 greatly changes between the normal state and the abnormal state, and thus the abnormality of GPF 50 can be accurately determined.

In the above-described embodiment, the flow rate of the exhaust gas that collides with the air-fuel ratio sensor 70 is lower than that in the normal state at the time of abnormality, whereas in the first modification, the flow rate of the exhaust gas that collides with the air-fuel ratio sensor 70 is higher than that in the normal state at the time of abnormality. Therefore, in the first modification, it is necessary to install the air-fuel ratio sensor 70 at a position where the flow rate of the exhaust gas increases at the time of abnormality, and the restriction of the installation position of the air-fuel ratio sensor 70 is larger than that in the above-described embodiment. Therefore, in consideration of the restriction of the installation position of the air-fuel ratio sensor 70, it is preferable to install the air-fuel ratio sensor 70 as in the above-described embodiment.

Second Modification

Figure 5A:
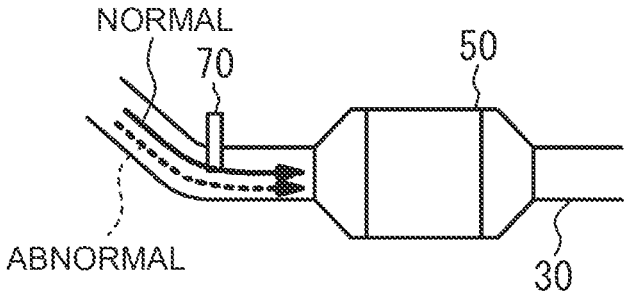
FIG. 5A is an explanatory view of a second modification.

FIG. 5A is an explanatory diagram of a second modification. FIG. 5A corresponds to FIG. 2A. In the second modification, unlike the above-described embodiment, the three-way catalyst 40 and the air-fuel ratio sensor 60 are not provided. Even with such a configuration, it is possible to determine whether or not GPF 50 is abnormal based on the detected air-fuel ratio of the air-fuel ratio sensor 70 during the execution of the imbalance control.

Third Modification

Figure 5B:
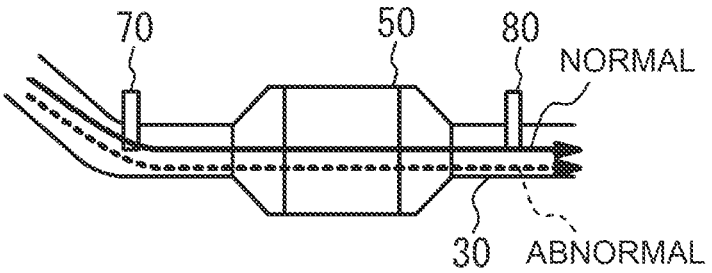
FIG. 5B is an explanatory view of a third modification.

FIG. 5B is an explanatory diagram of a third modification. FIG. 5B corresponds to FIG. 2A. In the third modification, unlike the above-described embodiment, the three-way catalyst 40 and the air-fuel ratio sensor 60 are not provided, and the air-fuel ratio sensor 80 is provided in the exhaust passage 30 downstream of GPF 50. Even with such a configuration, it is possible to determine whether or not GPF 50 is abnormal based on the detected air-fuel ratio of the air-fuel ratio sensor 70 during the execution of the imbalance control.

In the third modification, the abnormal GPF 50 may be determined based on the detected air-fuel ratio of the air-fuel ratio sensor 80 provided downstream of GPF 50. In the abnormal state, the pressure loss of the exhaust gas is smaller than that in the normal state, so that the pressure loss of the exhaust gas discharged from GPF 50 is also smaller. As a result, the flow rate of the exhaust gas colliding with the air-fuel ratio sensor 80 increases in the abnormal state than in the normal state. Therefore, in the third modification, ECU 100 may determine whether or not the detected air-fuel ratio of the exhaust gas of the cylinder #1 by the air-fuel ratio sensor 80 is equal to or greater than the determination value, and may determine whether or not the detected air-fuel ratio is less than the determination value. Here, GPF 50 has a cone portion having a reduced diameter in the flow direction of the exhaust gas. The exhaust gas is throttled by the cone portion to increase the flow velocity. As described above, since the air-fuel ratio sensor 80 is provided at a position where the flow rate of the exhaust gas is increased by the cone portion, the flow rate of the exhaust gas is further increased on the downstream side of the cone portion than in the normal case in the abnormal case, and the flow rate of the exhaust gas that collides with the air-fuel ratio sensor 80 is further increased. Consequently, an anomaly in GPF 50 can be accurately determined. For example, GPF 50 may be installed close to the engine 10 in view of the temperature rise of GPF 50 due to the exhausted air. In this case, the air-fuel ratio sensor 80 may be provided on the downstream side of GPF 50 without providing the air-fuel ratio sensor 70 on the upstream side of GPF 50, and the anomaly determination may be performed based on the detected air-fuel ratio of the air-fuel ratio sensor 80. For example, the air-fuel ratio sensor 80 may be provided in a cone portion downstream of GPF 50 housing.

Fourth Modification

Figure 5C:
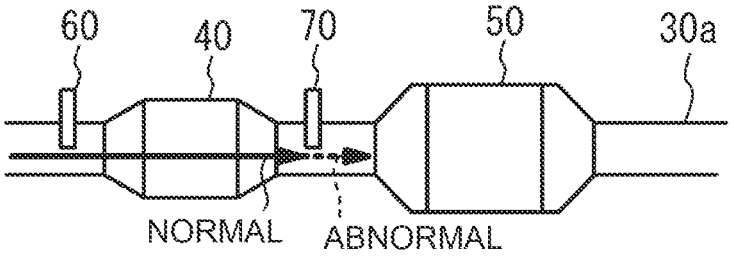
FIG. 5C is an explanatory diagram of a fourth modification.

FIG. 5C is an explanatory diagram of a fourth modification. FIG. 5C corresponds to FIG. 2A. The exhaust passage 30*a* in the fourth modification extends linearly unlike the above-described embodiment. The air-fuel ratio sensor 70 is provided at a linear portion of the exhaust passage 30*a*. Also in this case, the pressure loss of the exhaust gas is smaller than that in the normal state in the abnormal state. Here, since the exhaust passage 30*a* extends linearly, the flow direction of the exhaust gas does not significantly change between the normal state and the abnormal state, but the flow velocity of the exhaust gas becomes faster than in the normal state in the abnormal state. As a result, the flow rate of the exhaust gas colliding with the air-fuel ratio sensor 70 increases in the abnormal state than in the normal state. Therefore, in the fourth modification, ECU 100 determines whether or not the detected air-fuel ratio of the exhaust gas of the cylinder #1 by the air-fuel ratio sensor 70 is equal to or greater than the determination value, and when the detected air-fuel ratio is less than the determination value, ECU 100 performs the anomaly determination.

In the fourth modification, the air-fuel ratio sensor 70 is provided on the downstream side of the three-way catalyst 40. Here, the exhaust gas is throttled by the cone portion on the downstream side of the housing of the three-way catalyst 40, and the flow velocity is increased. Therefore, the flow rate of the exhaust gas that collides with the air-fuel ratio sensor 70 is further increased in the abnormal state than in the normal state, so that the abnormal state of GPF 50 can be accurately determined.

In the above-described embodiments and modifications, an $O_2$ sensor for detecting the oxygen concentration in the exhaust gas may be used instead of the air-fuel ratio sensor 70. The filter abnormality determination system 1 of the filters, for example, may be mounted on the engine vehicle, or may be mounted on hybrid electric vehicle.

Although the embodiments of the present disclosure have been described in detail above, the present disclosure is not limited to such specific embodiments, and various modifications and changes can be made within the scope of the gist of the present disclosure described in the claims.

What is claimed is:

1. A filter abnormality determination system comprising:

an internal combustion engine including a plurality of cylinders;

an exhaust passage connected to the internal combustion engine;

a filter provided in the exhaust passage;

a sensor that is provided in the exhaust passage so as to face the filter and that outputs a detected value corresponding to an air-fuel ratio in exhaust gas;

a plurality of injection valves provided in the plurality of cylinders respectively; and a processor, wherein the processor is configured to:

control fuel injection amount of the plurality of injection valves, execute imbalance control for controlling an air-fuel ratio of one cylinder of the plurality of cylinders, so as to control the air-fuel ratio of the one cylinder to a rich air-fuel ratio that is smaller than a stoichiometric air-fuel ratio or control the air-fuel ratio of the one cylinder to a lean air-fuel ratio that is larger than the stoichiometric air-fuel ratio, compare the detected value of the sensor in a case where the imbalance control is executed with a predetermined value, and determine that the filter is abnormal in a case where the detected value is below the predetermined value, wherein the exhaust passage includes a curved portion that is located upstream of the filter, and that extends with a curvature, the curved portion includes an inner wall portion and an outer wall portion that face each other in a radial direction of the curvature, the outer wall portion having a larger radius of curvature than the inner wall portion, and the sensor is provided at the outer wall portion of the curved portion.

2. The filter abnormality determination system according to claim 1, the predetermined value is predetermined based on a minimum air-fuel ratio of the exhaust gas of the one cylinder detected by the sensor.

* * * * *